US011320127B2

(12) United States Patent
Thomas et al.

(10) Patent No.: US 11,320,127 B2
(45) Date of Patent: May 3, 2022

(54) APPARATUSES AND METHODS FOR RESTRAINING A LIGHTING FIXTURE SELECTOR

(71) Applicant: RAB Lighting Inc., Northvale, NJ (US)

(72) Inventors: Cecil Thomas, Demarest, NJ (US); Wengang Gao, Ningbo (CN)

(73) Assignee: RAB Lighting Inc., Northvale, NJ (US)

( * ) Notice: Subject to any disclaimer, the term of this patent is extended or adjusted under 35 U.S.C. 154(b) by 0 days.

(21) Appl. No.: 16/797,651

(22) Filed: Feb. 21, 2020

(65) Prior Publication Data

US 2021/0262649 A1 Aug. 26, 2021

(51) Int. Cl.

| | |
|---|---|
| ***F21V 23/04*** | (2006.01) |
| ***H01H 9/02*** | (2006.01) |
| ***H05B 45/20*** | (2020.01) |
| ***H05B 45/10*** | (2020.01) |
| *F21Y 115/10* | (2016.01) |

(52) U.S. Cl.

CPC ..... *F21V 23/04* (2013.01); *H01H 9/02* (2013.01); *H05B 45/10* (2020.01); *H05B 45/20* (2020.01); *F21Y 2115/10* (2016.08)

(58) Field of Classification Search

CPC ..... F21V 21/08; F21V 21/14; F21V 21/30; F21V 21/34; F21V 23/04

USPC ..... 362/295, 394, 490

See application file for complete search history.

(56) References Cited

U.S. PATENT DOCUMENTS

| | | | | |
|---|---|---|---|---|
| 3,170,050 A | | 2/1965 | Buturuga | |
| 3,678,236 A | | 7/1972 | Hughes | |
| 4,286,311 A | * | 8/1981 | Maglica | F21L 4/005 200/242 |

(Continued)

FOREIGN PATENT DOCUMENTS

| | | |
|---|---|---|
| CA | 2998173 | 7/2018 |
| WO | 2004070757 | 8/2004 |
| WO | 2017127836 | 7/2017 |

OTHER PUBLICATIONS

Lutron Electronics Co., Inc.; Lutron Aurora Smart Bulb Dimmer For Philips Hue Bulbs; Retrieved from the Internet on Nov. 18, 2019 from www.lutron.com/en-US/Products/Pages/StandAloneConrols/Dimmers-Switches/SmartBulbDimmer/overview.aspx.

Michael Brown; TechHive; Lutron Aurora Review: A Nearly Perfect Solution for Philips Hue Smart Bulbs; Retrieved from the Internet on Nov. 18, 2019 from https://www.techhive.com/article/3429587/lutron-aurora-review.html.

(Continued)

*Primary Examiner* — Tung X Le

(74) *Attorney, Agent, or Firm* — Frost Brown Todd LLC; Dennis S. Schell

(57) ABSTRACT

Systems and methods that permit initial selection of a lighting fixture output characteristic and inhibit later change of the lighting fixture output characteristic are disclosed. Embodiments include one or more devices that inhibit a lighting fixture control switch from being moved between two different positions. In some embodiments the control switch extends through an aperture in the a housing of the lighting fixture and the one or more devices are inserted into the aperture and embrace the control switch in one of the control switch's operational positions. In some embodiments the configuration of the apertures and the devices permits the devices to be inserted into the apertures in a single orientation. Some embodiments include devices with an outer surface that defines the switch embracing portion, and some embodiments include devices that are difficult to remove by hand after insertion into the aperture.

20 Claims, 9 Drawing Sheets

(56) References Cited

U.S. PATENT DOCUMENTS

| | | | | |
|---|---|---|---|---|
| 4,316,067 | A * | 2/1982 | Whiteman, Jr. | H01H 15/005 200/16 D |
| 4,347,412 | A | 8/1982 | Mihara et al. | |
| 4,363,944 | A | 12/1982 | Poirier | |
| 4,404,619 | A * | 9/1983 | Ferguson | F21V 9/40 362/222 |
| 4,468,544 | A | 8/1984 | Wainess et al. | |
| 4,506,120 | A | 3/1985 | Fleischman | |
| 4,876,425 | A | 10/1989 | Woskow | |
| 5,278,365 | A | 1/1994 | Rowley et al. | |
| 5,723,832 | A | 3/1998 | Hall | |
| 5,868,242 | A | 2/1999 | Hall et al. | |
| 5,909,019 | A | 6/1999 | Maloney et al. | |
| 6,118,088 | A | 9/2000 | Thielman | |
| 6,242,872 | B1 * | 6/2001 | Ha | H05B 47/16 315/293 |
| 6,472,619 | B1 * | 10/2002 | Halphide | H01H 9/286 200/43.16 |
| 6,817,738 | B1 * | 11/2004 | Winters | G02B 27/024 362/367 |
| 9,614,356 | B2 * | 4/2017 | Natili | H02B 1/0565 |
| 9,859,074 | B1 * | 1/2018 | Martinez | H01H 9/28 |
| 2003/0057065 | A1 * | 3/2003 | Hecker | H01H 23/14 200/43.16 |
| 2011/0162942 | A1 | 7/2011 | Garvin et al. | |
| 2011/0222211 | A1 * | 9/2011 | Siebels | H01H 71/0264 361/634 |
| 2012/0127702 | A1 * | 5/2012 | Lax | F21V 23/06 362/184 |
| 2013/0092516 | A1 | 4/2013 | Ray | |
| 2017/0354023 | A1 | 12/2017 | Dimberg et al. | |
| 2021/0098213 | A1 * | 4/2021 | Fitch | H01H 23/145 |

OTHER PUBLICATIONS

Walmart; Online shopping page; E-Lock Switch Guard Light Switch Cover, Twin Pack, White; Retrieved from the Internet on Nov. 18, 2019 from https://www.walmart.com/ip/E-Lock-Switch-Guard-Light-Switch-Cover-Twin-Pack-White/43971232.

E-Lock Switch Guard; e-Lock Switch Guard, Don't Touch That Switch!; Retrieved from the Internet on Nov. 18, 2019 from https://www.elockswitchguard.com/about-e-lock-switch-guard.

Kyle Switch Plates; Shopping page; Toggle Switch Lock Plate for Decorative Light Switch Covers; Retrieved from the Internet on Nov. 18, 2019 from https://www.kyleswitchplates.com/toggle-switch-lock-plate-for-decorative-light-switch-covers.

The Home Depot Shopping Page; Adamax; Switch Lock Plate; Retrieved from the Internet on Aug. 24, 2020 from https://www.homedepot.com/p/Adamax-Switch-Lock-Plate-White-SLGWH/205051916.

Amazon Shopping Page; Switch Shield; Clear Light Switch Guards; Retrieved from Internet on Aug. 24, 2020 from https://www.amazon.com/Option-Switch-Guards-Clear-Toggle/dp/B00DTXKOTM.

Amazon Shopping Page; Light Switch Guard; Retrieved from the Internet on Aug. 24, 2020 from https://www.amazon.com/Switch-Guard-ILIVABLE-Cover-Accidentally/dp/B07KVR3BPP/ref=cts_ba_1_vtp.

Kyle Switch Plates Shopping page; Toggle Switch Lock Guard; Retrieved from the Internet on Aug. 24, 2020 from https://www.kyleswitchplates.com/toggle-switch-lock-guard/.

Do It Best Shopping Page; Hillman Fastener Clear Plastic Switch Lock (2-Pack); Retrieved from the Internet on Aug. 24, 2020 from https://www.doitbest.com/shop/electrical/switches-outlets-and-wall-plates/switch-accessories/switch-lock/switch-lock?SKU=514721.

* cited by examiner

APPARATUSES AND METHODS FOR RESTRAINING A LIGHTING FIXTURE SELECTOR

FIELD

Embodiments of this disclosure relate generally to lighting fixtures, also referred to as light fixtures or luminaires.

BACKGROUND

Lighting fixtures can include user actuated control devices, such as switches, that allow a user to change at least one characteristic of the light emanating from the lighting fixture during operation. However, it was realized by the inventors of the current disclosure that problems exist with some lighting control devices that allow users to change the characteristic of the light emanating from the lighting fixture after the lighting fixture has been installed and that improvements in the ability to inhibit variation of these lighting fixture control devices are needed. Certain preferred features of the present disclosure address these and other needs and provide other important advantages.

SUMMARY

Embodiments of the present disclosure provide an improved apparatuses and methods for restraining a lighting fixture selector.

Power companies frequently offer discounts or rebates for customers who install energy efficient lighting fixtures. However, customers can desire different options for achieving these discounts, such as, desiring incrementally brighter light for a smaller discount. There can also be regions where the color temperature of the light is regulated or incentivized. For manufactures, manufacturing a single light fixture that can be adapted for different light intensities and/or different color temperatures is advantageous since one fixture can be used to meet different demands, but power companies can resist offering discounts or rebates for light fixtures that allow a user to change the power consumption and/or color temperature of the lighting fixtures. Power companies can offer discounts and/or rebates for lighting fixtures that allow an installer, such as an electrician, to easily set the lighting fixture to a particular power consumption or color temperature setting and limit the ability of a user to adjust the power consumption and/or color temperature of the lighting fixture after the lighting fixture has been installed by the electrician.

Various aspects of different embodiments of the present disclosure are expressed in the following three (3) paragraphs as follows.

At least one embodiment of the present disclosure includes an apparatus limiting the ability of a user to change the position of a multi-position switch that affects at least one characteristic of a light emitting member, the apparatus comprising: a body defining an outer surface and a switch receiving portion, the outer surface configured to be held in position by interaction with an aperture surrounding a multi-position electrical switch of a lighting fixture, the switch affecting at least one characteristic of a light emitting member when moved from a first position to a second position, and the switch receiving portion configured to receive the multi-position switch when the multi-position switch is in the first position and inhibit the multi-position switch from moving to the second position.

At least one other embodiment of the present disclosure includes a kit for a light fixture, comprising: a light fixture housing defining an aperture; a light emitting member mounted to the light fixture housing; a switch connected to the light emitting member and configured to extend through the aperture, the switch affecting at least one aspect of the light being emitted from the light emitting member when moved between a first position and a second position; a first body defining a first outer surface and a first body switch receiving portion, the first outer surface configured to be received by the aperture, and the first body switch receiving portion being configured to receive the switch when the switch is in a first position and inhibit the switch from moving to a second position; and a second body defining a second outer surface and a second switch receiving portion, the second outer surface configured to be received by the aperture, and the second body switch receiving portion being configured to receive the switch when the switch is in the second position and inhibit the switch from moving to the first position.

At least one further embodiment of the present disclosure includes a kit that limits movement of a light switch that controls at least one aspect of the light emitting from a light fixture, the light switch extending through an aperture in a housing of the light fixture, the kit comprising: a first light switch movement inhibiting member including means for orienting the first light switch movement inhibiting member in a single orientation within a light housing aperture and inhibiting the light switch from moving from a first light switch position to a second light switch position when the first light switch movement inhibiting member is received within the aperture in the light housing; and a second light switch movement inhibiting member including means for orienting the second light switch movement inhibiting member in a single orientation within the light housing aperture and inhibiting the light switch from moving from the second light switch position to the first light switch position when the second light switch movement inhibiting member is received within the light housing aperture.

Yet other embodiments include the features described in any of the previous three paragraphs as combined with (i) one or more of the previous three (3) paragraphs, (ii) one or more of the following seventeen (17) paragraphs, or (iii) one or more of the previous three (3) paragraphs and one or more of the following seventeen (17) paragraphs.

Wherein the outer surface, the first outer surface and/or the second outer surface defines the switch receiving portion.

Wherein the outer surface of the body is configured to be received within the aperture without damage.

Wherein the outer surface of the body is configured to be received within the aperture in a single rotational orientation with respect to the aperture.

A second body defining a second outer surface and a second light switch receiving portion, the second outer surface is optionally configured to be snugly received within the aperture surrounding the multi-position switch, and the second switch receiving portion is optionally configured to receive the multi-position switch when the multi-position switch is in the second position and inhibit the multi-position switch from moving to the first position.

Wherein removing the body, the first body and/or the second body from the aperture results in damage to the body, the first body and/or the second body that is apparent to an ordinary user.

Wherein removing the body, the first body and/or the second body from the aperture results in damage to the body, the first body and/or the second body that is apparent to an ordinary user.

Wherein removing the body, the first body and/or the second body from the aperture results in damage to the body, the first body and/or the second body that is apparent to an ordinary user when the body, the first body and/or the second body is reinserted into the aperture.

Wherein the body, the first body and/or the second body is a body of unitary construction.

Wherein the body, the first body and/or the second body is constructed of an elastomeric material.

Wherein the switch receiving portion is configured to receive a toggle switch.

Wherein an ordinary user is unable to remove the body from the aperture without use of a tool.

Wherein the outer surface of the body is larger than the aperture resulting in the body being snugly received within the aperture.

Wherein the first outer surface and/or the second outer surface are configured to be received within the aperture without damage.

Wherein the first outer surface and/or the second outer surface are configured to be received within the aperture in a single rotational orientation with respect to the aperture.

Wherein the body, the first body and/or the second body is held in position within the aperture by the contact force between the outer surface of the body, the first body and/or the second body and the aperture.

Wherein the means for orienting the first and/or second light switch movement inhibiting member includes a light switch embracing portion that embraces the light switch in the first and/or second light switch position.

Wherein the means for orienting the first and/or second light switch movement inhibiting member includes a key that orients the first and/or second light switch movement inhibiting member in a single orientation within the housing of the light fixture.

This summary is provided to introduce a selection of the concepts that are described in further detail in the detailed description and drawings contained herein. This summary is not intended to identify any primary or essential features of the claimed subject matter. Some or all of the described features may be present in the corresponding independent or dependent claims, but should not be construed to be a limitation unless expressly recited in a particular claim. Each embodiment described herein does not necessarily address every object described herein, and each embodiment does not necessarily include each feature described. Other forms, embodiments, objects, advantages, benefits, features, and aspects of the present disclosure will become apparent to one of skill in the art from the detailed description and drawings contained herein. Moreover, the various apparatuses and methods described in this summary section, as well as elsewhere in this application, can be expressed as a large number of different combinations and subcombinations. All such useful, novel, and inventive combinations and subcombinations are contemplated herein, it being recognized that the explicit expression of each of these combinations is unnecessary.

BRIEF DESCRIPTION OF THE DRAWINGS

Some of the figures shown herein may include dimensions or may have been created from scaled drawings. However, such dimensions, or the relative scaling within a figure, are by way of example, and not to be construed as limiting.

DETAILED DESCRIPTION OF THE ILLUSTRATED EMBODIMENTS

Figure 1:
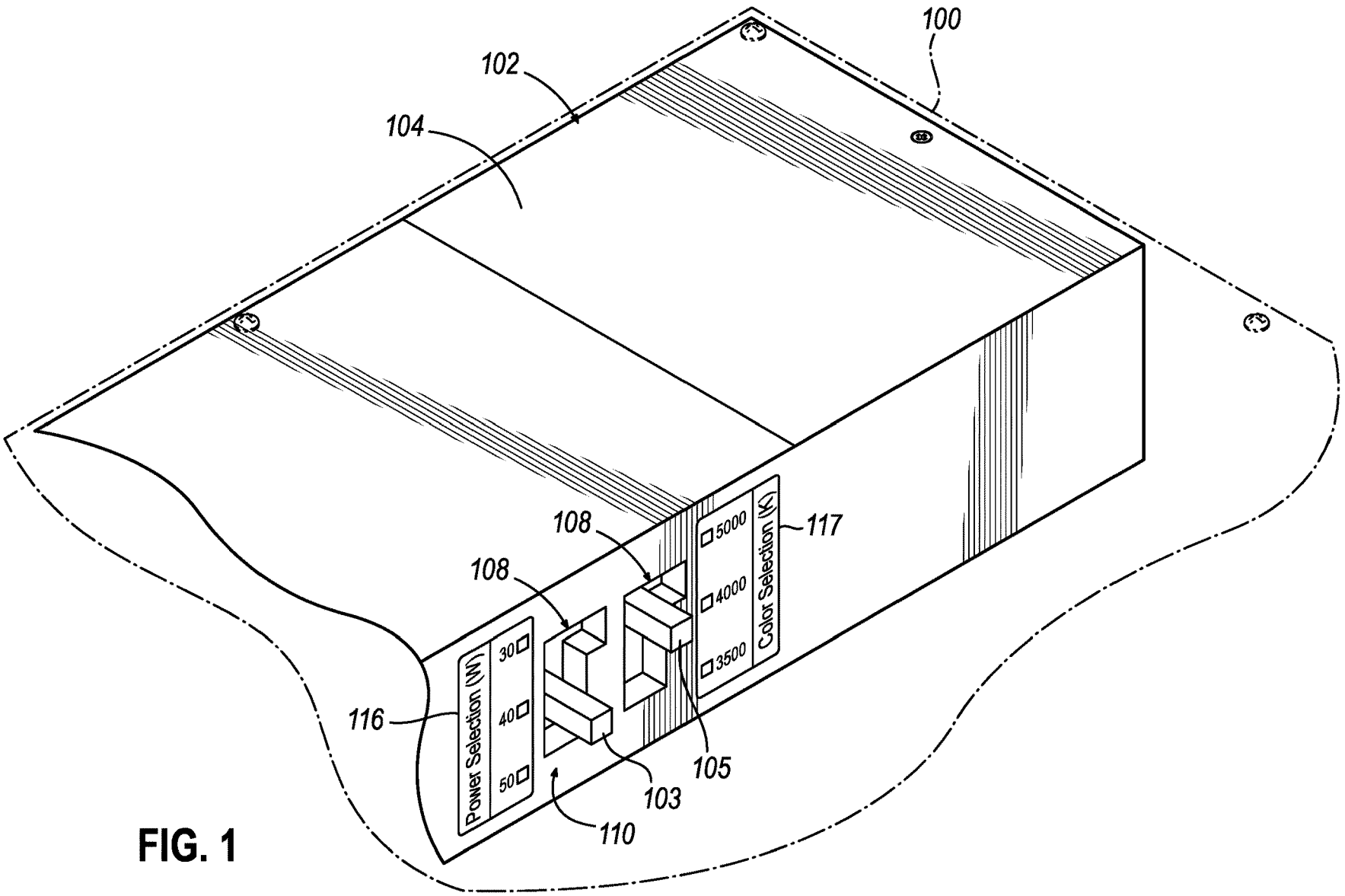
FIG. 1 is a perspective view of a lighting fixture according to one embodiment of the present disclosure.

For the purposes of promoting an understanding of the principles of the disclosure, reference will now be made to one or more embodiments, which may or may not be illustrated in the drawings, and specific language will be used to describe the same. It will nevertheless be understood that no limitation of the scope of the disclosure is thereby intended; any alterations and further modifications of the described or illustrated embodiments, and any further applications of the principles of the disclosure as illustrated herein are contemplated as would normally occur to one skilled in the art to which the disclosure relates. At least one embodiment of the disclosure is shown in great detail, although it will be apparent to those skilled in the relevant art that some features or some combinations of features may not be shown for the sake of clarity.

Any reference to "invention" within this document is a reference to an embodiment of a family of inventions, with no single embodiment including features that are necessarily included in all embodiments, unless otherwise stated. Furthermore, although there may be references to benefits or advantages provided by some embodiments, other embodiments may not include those same benefits or advantages, or may include different benefits or advantages. Any benefits or advantages described herein are not to be construed as limiting to any of the claims.

Likewise, there may be discussion with regards to "objects" associated with some embodiments of the present invention, it is understood that yet other embodiments may not be associated with those same objects, or may include yet different objects. Any advantages, objects, or similar words used herein are not to be construed as limiting to any of the claims. The usage of words indicating preference, such as "preferably," refers to features and aspects that are present in at least one embodiment, but which are optional for some embodiments.

Specific quantities (spatial dimensions, temperatures, pressures, times, force, resistance, current, voltage, concentrations, wavelengths, frequencies, heat transfer coefficients, dimensionless parameters, etc.) may be used explicitly or implicitly herein, such specific quantities are presented as examples only and are approximate values unless otherwise indicated. Discussions pertaining to specific compositions of matter, if present, are presented as examples only and do not limit the applicability of other compositions of matter, especially other compositions of matter with similar properties, unless otherwise indicated.

Embodiments of the present disclosure provide methods and apparatuses for limiting the ability of a user to change the illumination output of a light fixture after the illumination has been set. In one example embodiment devices are used that restrict the ability of a user to move a switch (for example a toggle switch, a rotary switch or other form of mechanical switch), that controls the illumination output of a lighting fixture. The devices include portions that allow the devices to be securely mounted to the switch housing and portions that restrain the switch in a specific orientation. In some examples, the devices are inserted into an aperture through which a switch extends and include an aperture that receives the switch and holds it in a particular position. Embodiments can be difficult to remove from the switch housing and can be of unitary construction. Use of these devices can allow users to receive rebates or incentives from power companies for operating light fixtures with certain characteristics, such as low power consumption.

Depicted in FIG. 1 is a luminaire 100 with one or more light sources (for example, light emitting diodes (LEDs), not depicted), a housing 104 and a controller 102. The one or more light sources in luminaire 100 are functionally controlled, at least in part, by controller 102. Controller 102 includes one or more user selectable illumination control selectors 110 (for example, toggle switches 103 and 105) that control one or more characteristics of the light being illuminated by the light sources. The toggle switches 103 and 105 extend outside the housing 104 of luminaire 100 through one or more illumination selector accesses (for example, apertures 108 allowing access by a user, such as an electrician. Illumination selector legends 116 and 117 may optionally be included to assist a user in placing the toggle switches 103 and 105 in the desired positions.

Figure 2:
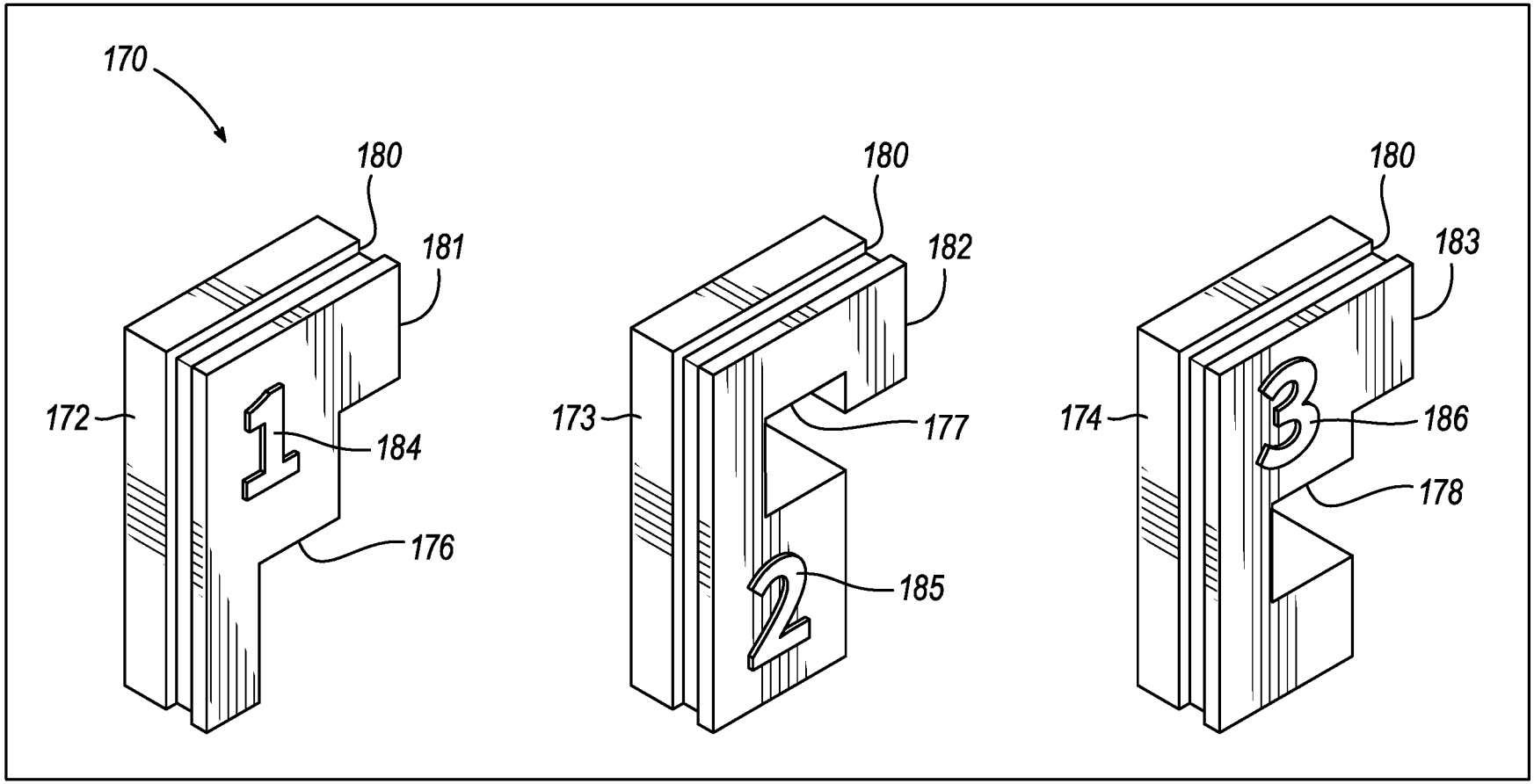
FIG. 2 is a perspective view of switch restraining members according to one embodiment of the present disclosure.

Depicted in FIG. 2 are switch restraining members (which are occasionally referred to as selector switch restraining collars) that may be included as at least part of a locking member kit 170 that is configured and adapted for use with luminaire 100 according to one embodiment of the present disclosure. Locking member kit 170 includes one or more switch restraining members, for example locking member 172, locking member 173 and locking member 174. Each of the locking members 172, 173 and 174 includes an illumination selector receiving portion, for example, toggle switch embracing portion 176, toggle switch receiving portion 177 and toggle switch receiving portion 178, respectively, which can embrace the toggle switch (for example, snugly embrace the toggle switch with at least two opposing sides of the outer surface of the toggle switch exert a nonzero contact force (for example, a nonzero pressure) on the inner surface of the aperture 108 into which it is inserted). One or more of the locking members 172, 173 and 174 in the locking member kit 170 optionally include a housing engagement feature, for example, a groove 180, that increases the difficulty in removing the locking member from the housing once the locking member is installed. One or more of the locking members 172, 173 and 174 may also optionally include identification features 184, 185 and/or 186 to assist a user in identifying the appropriate locking member 172, 173 or 174.

Figure 3:
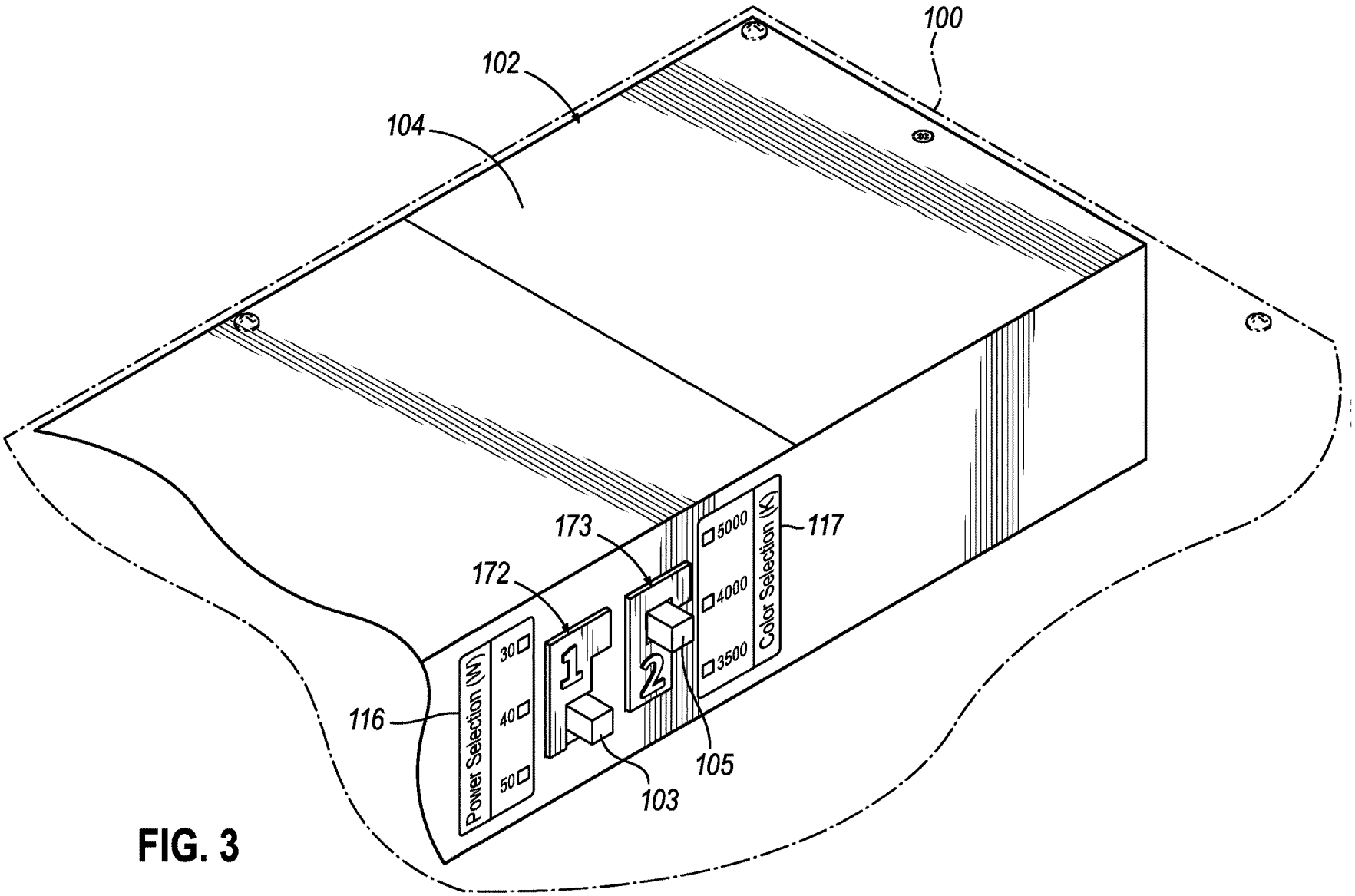
FIG. 3 is a perspective view of two switch restraining members depicted in FIG. 2 inserted into apertures in the lighting fixture depicted in FIG. 1.

The locking members 172, 173 and 174 include switch embracing portions that hold an illumination selector (for example, toggle switches 103 and 105) in a particular position when mounted to an illumination selector access (for example, aperture 108) of housing 104. Using FIG. 3 as an example, when locking member 172 is mounted to the left aperture 108 the illumination selector (toggle switch 103) is held in the lower (50 Watt) position, and when locking member 173 is mounted to the right aperture 108 the illumination selector (toggle switch 105) is held in the upper (5000 Kelvin) position. Similarly, if locking member 174 is mounted to the left or right aperture in FIG. 3, the illumination selector (toggle switch 103 or toggle switch 105, respectively) will be held in the middle (40 Watt or 4000 Kelvin, respectively) position.

One or more of the locking members (for example, locking members 172, 173 and/or 174) are optionally asymmetric in shape requiring the locking member to be inserted into its corresponding aperture (for example, apertures 108) in a single orientation. For example, the locking members 172, 173 and 174 depicted in FIGS. 2 and 3-8 have orientation features 181, 182 and 183, respectively (which may also take the form of traditional keyed portions such as slots and tabs or asymmetrical geometric shapes) requiring the locking members 172, 173 and 174 to be placed in a particular orientation prior to insertion into an aperture 108. Different locking members hold the illumination selector in different positions and inhibit movement of the illumination selector away from the particular position in which the illumination selector is being held. Although the locking members depicted in FIG. 2 hold an illumination member in one (1) of three (3) different positions, other embodiments include locking members that hold an illumination member in two (2) different positions, which further embodiments include locking members that hold an illumination member in four (4) or more different positions.

In use, a user selects the appropriate positions for toggle switches 103 and 105 to comply with the desired light output for luminaire 100 and inserts the appropriate one or more locking members (for example, locking member 172, 173 and/or 174) into the one or more housing apertures 108 (which surround toggle switches 103 and 105) and secures one or more toggle switches 103 and 105 in the appropriate positions. When inserted into an aperture 108, the outer surface of the locking member 172, 173 and/or 174 engage the inner surface of the aperture 108 into which the locking member is inserted and the interaction (for example, friction, pressure or other holding force) between the outer surface of the locking member 172, 173 and/or 174 and the inner surface of the aperture 108 into which the locking member is inserted hold the locking member in position within the aperture 108. The embracing portion 176, 177 and/or 178 of the inserted locking member 172, 173 and/or 174 (each of which is a portion of the outer surface of the respective locking member) receives the toggle switch 103 or 105 (and may embrace the toggle switch 103 or 105 by contacting at least a portion of the toggle switch 103 or 105) and prevents the toggle switch 103 or 105 from moving to a different position. In at least one embodiment, the outer surface of the locking member 172, 173 and/or 174 is larger than the aperture 108 resulting in the locking member 172, 173 and/or 174 being snugly received within the aperture 108. If included with locking members 172, 173 and 174, grooves 180 engage with the border edge of apertures 108 and increase the effort required to remove locking members 172, 173 and 174 from apertures 108.

With the appropriate locking members 172, 173 and 174 positioned within apertures 108 for the desired light output, it is difficult to change the positioning of the toggle switches 103 and 105. For example, a user may need to locate and use a tool, and in some embodiments a specially designed tool, to extract locking members 172, 173 and 174 from apertures 108. In some embodiments extracting locking members 172, 173 or 174 from apertures 108 will physically damage locking members 172, 173 and 174, providing a tamper evident system for assisting possible inspectors in determining whether the positioning of toggle switches 103 and 105 have been changed since installation.

With the appropriate locking members 172, 173 and 174 attached to housing 104, illumination selectors 103 and 105 are held in specific positions limiting the output of the light emitters (for example, LED lamps) to particular characteristics (for example, a specific power and/or color), allowing users of luminaire 100 to take advantage of various discounts and/or rebates offered by power companies and/or governmental agencies for using certain types of power or illumination.

Figure 4:
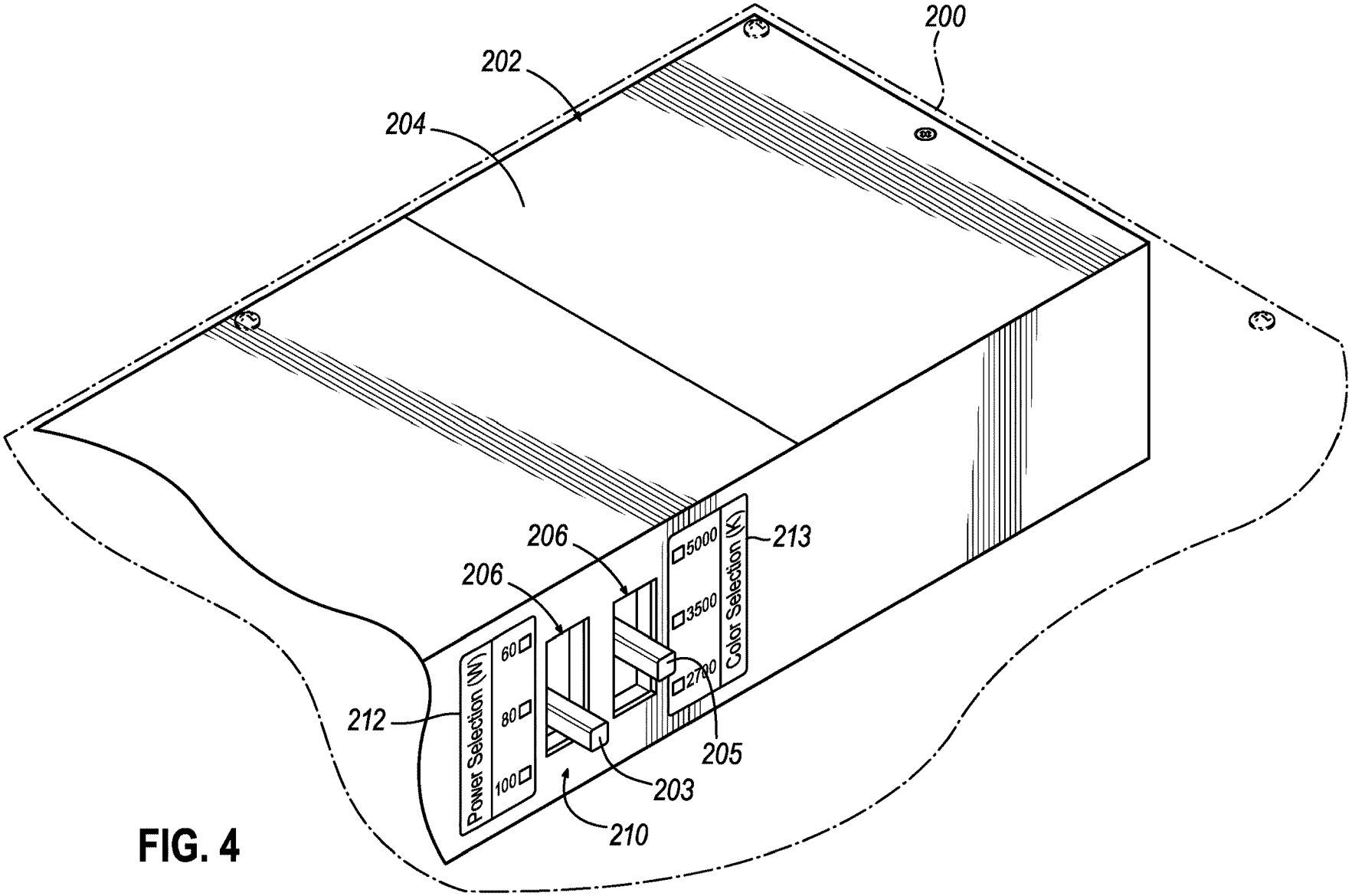
FIG. 4 is a perspective view of a lighting fixture according to another embodiment of the present disclosure.

Depicted in FIG. 4 is a luminaire 200 according to another embodiment of the present disclosure. Luminaire 200 includes one or more light sources (for example, light emitting diodes (LEDs), not depicted), a housing 204 and a controller 202. The one or more light sources in luminaire 200 are functionally controlled, at least in part, by controller 202. Controller 202 includes one or more user selectable illumination control selectors 210 (for example, toggle switches 203 and 205) that control one or more characteristics of the light being illuminated by the light sources. The toggle switches 203 and 205 extend outside the housing 204 of luminaire 200 through one or more illumination selector accesses (for example, apertures 206) allowing access by a user, such as an electrician. Illumination selector legends 212 and 213 may optionally be included to assist a user in placing the toggle switches 203 and 205 in the desired positions.

Figure 5:
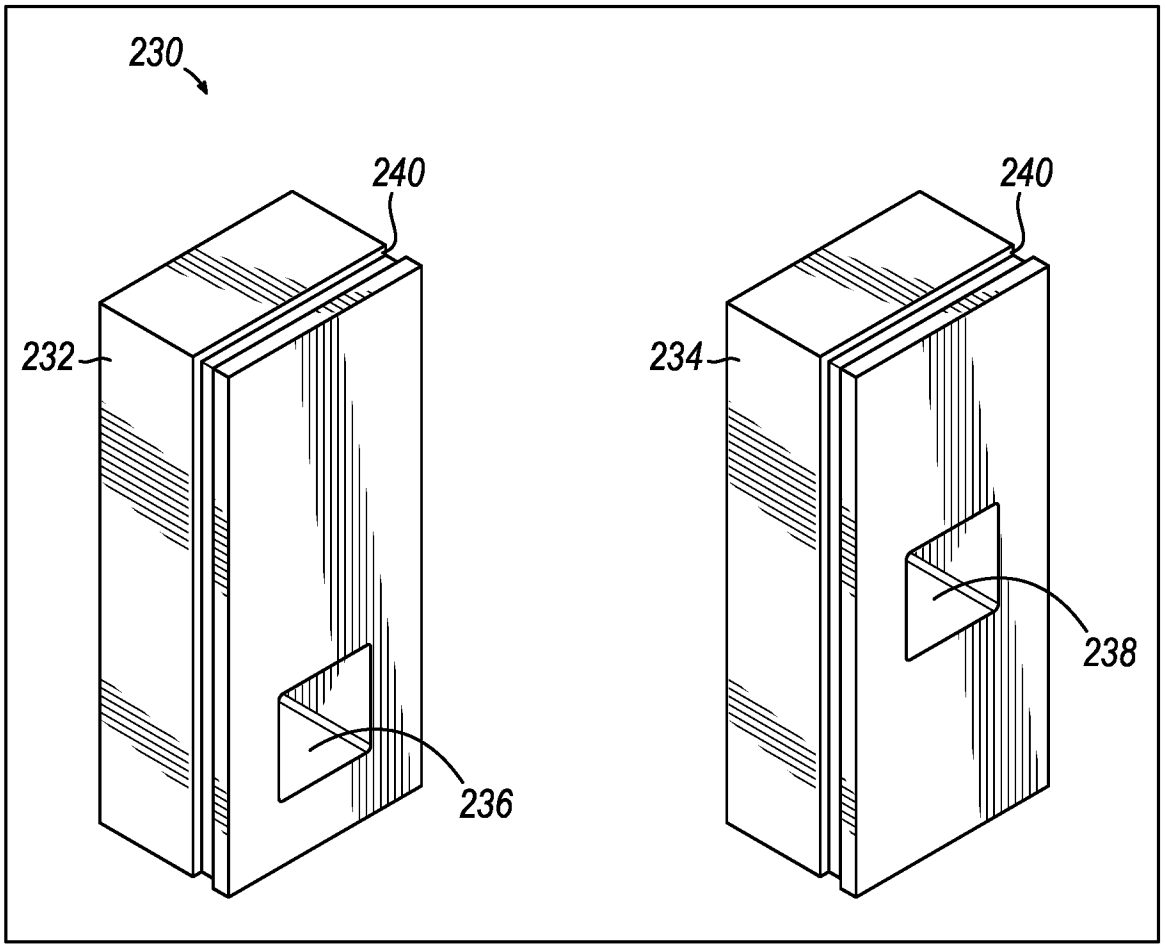
FIG. 5 is a perspective view of switch restraining members according to another embodiment of the present disclosure.
Figure 6:
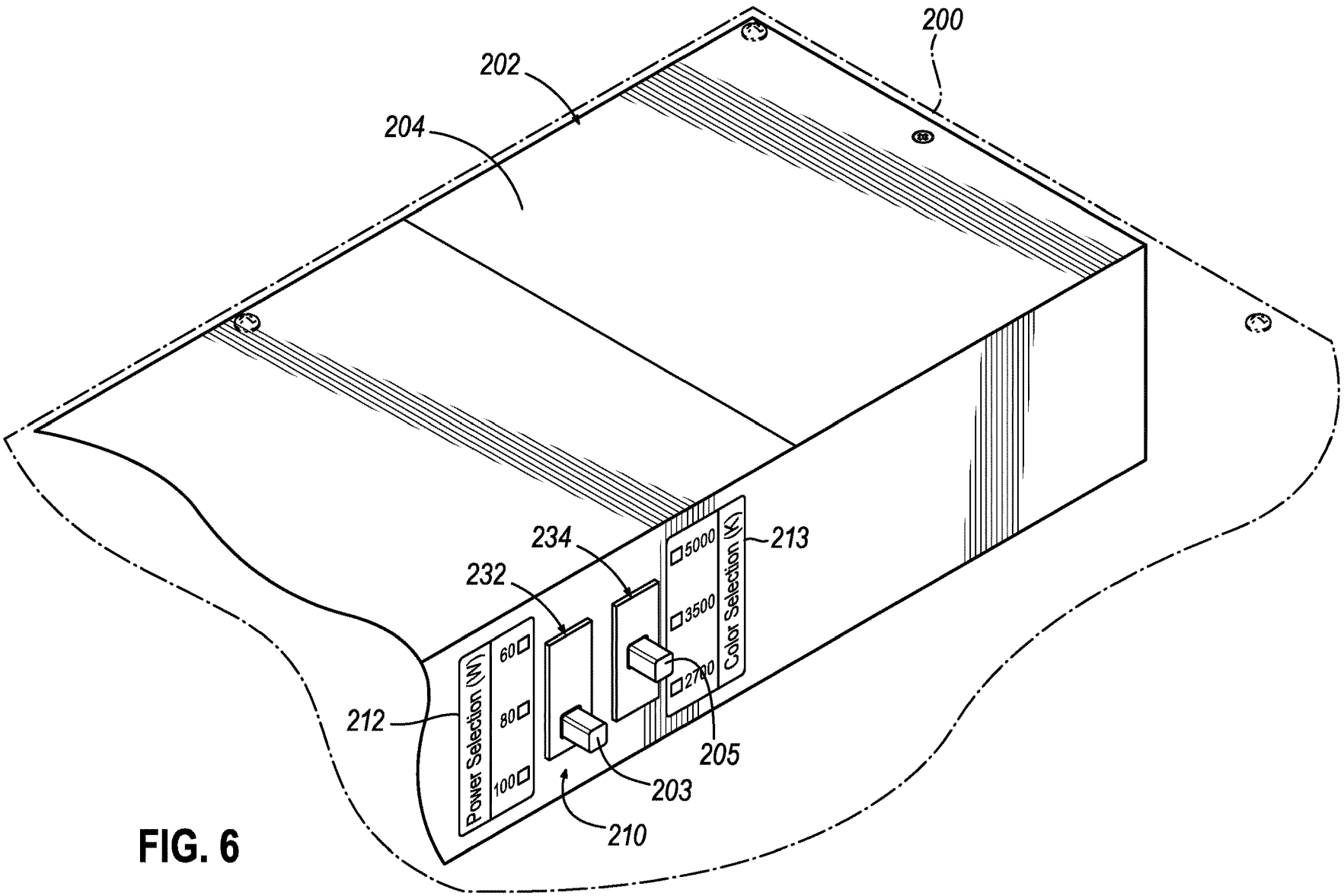
FIG. 6 is a perspective view of two switch restraining members depicted in FIG. 5 inserted into apertures in the lighting fixture depicted in FIG. 4.

Depicted in FIG. 5 are switch restraining members that may be included as at least part of a locking member kit 230 configured and adapted for use with luminaire 200 according to yet another embodiment of the present disclosure. Locking member kit 230 includes one or more switch restraining members, for example locking member 232 and locking member 234. Each of the locking members 232 and 234 includes an illumination selector receiving portion, for example, toggle switch embracing portion 236 and toggle switch embracing portion 238, respectively, which can embrace the toggle switch (for example, snugly embrace the toggle switch with at least two opposing sides of the outer surface of the toggle switch exert a nonzero contact force (for example, a nonzero pressure) on the inner surface of the aperture 206 into which it is inserted). One or more of the locking members 232 and 234 in the locking member kit 230 optionally include a housing engagement feature, for example, a groove 240, that increases the difficulty in removing the locking member from the housing once the locking member is installed.

Since the external shape of locking members 232 and 234 is rectangular, it is possible to insert each locking members 232 and 234 into apertures 206 in two orientations. For example, each of locking members 232 and 234 can be inserted into apertures 206 (see FIG. 4) in the orientations depicted in FIG. 5 and in orientations in which the locking members 232 and 234 have been rotated 180 degrees from the orientations depicted in FIG. 5. With locking members 232 and 234 rotated 180 degrees from the orientations depicted in FIG. 5, switch embracing portion 236 of locking member 232 will be oriented toward the upper end of the locking member 232 and the switch embracing portion 238 of locking member 234 will be in a similar, if not the same, orientation as depicted in FIG. 5 since switch embracing portion 238 is centrally located in locking member 234.

In use, a user selects the appropriate positions for toggle switches 203 and 205 to comply with the light output requirements for luminaire 200 and inserts the appropriate one or more locking members (for example, locking member 232 and/or 234) into the one or more housing apertures 206 (which surround toggle switches 203 and 205) and secures one or more toggle switches 203 and 205 in the appropriate positions. When inserted into an aperture 206, the outer surface of the locking member 232 and/or 234 engage the inner surface of the aperture 206 into which the locking member is inserted and the interaction (for example, friction, pressure or other holding force) between the outer surface of the locking member 232 and/or 234 and the inner surface of the aperture 206 into which the locking member is inserted hold the locking member in position within the aperture 206. The embracing portion 236 and/or 238 of the inserted locking member 232 and/or 234 (each embracing portion being at least a portion of an inner surface of an aperture within the respective locking member) receives the toggle switch 203 or 205 (and may embrace the toggle switch 203 or 205 by contacting at least a portion of the toggle switch 203 or 205) and prevents the toggle switch 203 or 205 from moving to a different position. In at least one embodiment, the outer surface of the locking member 236 and/or 238 is larger than the aperture 206 resulting in the locking member 236 and/or 238 being snugly received within the aperture 206. If included with locking members 232 and 234, grooves 240 engage with the border edge of apertures 206 and increase the effort required to remove locking members 232 and 234 from apertures 206.

With the appropriate locking members 232 and 234 positioned within apertures 206 for the desired light output, it is difficult to change the positioning of the toggle switches 203 and 205. For example, a user may need to locate and use a tool, and in some embodiments a specially designed tool, to extract locking members 232 and 234 from apertures 206. In some embodiments extracting locking members 232 and 234 from apertures 206 will physically damage locking members 232 and 234, providing a tamper evident system for assisting possible inspectors in determining whether the positioning of toggle switches 203 and 205 have been changed since installation.

With the appropriate locking members 232 and 234 attached to housing 204, illumination selectors 210 are held in specific positions limiting the output of the light emitters (for example, LED lamps) to particular characteristics (for example, a specific power and/or color), allowing users of luminaire 200 to take advantage of various discounts and/or rebates offered by power companies and/or governmental agencies for using certain types of power or illumination.

Figure 7:
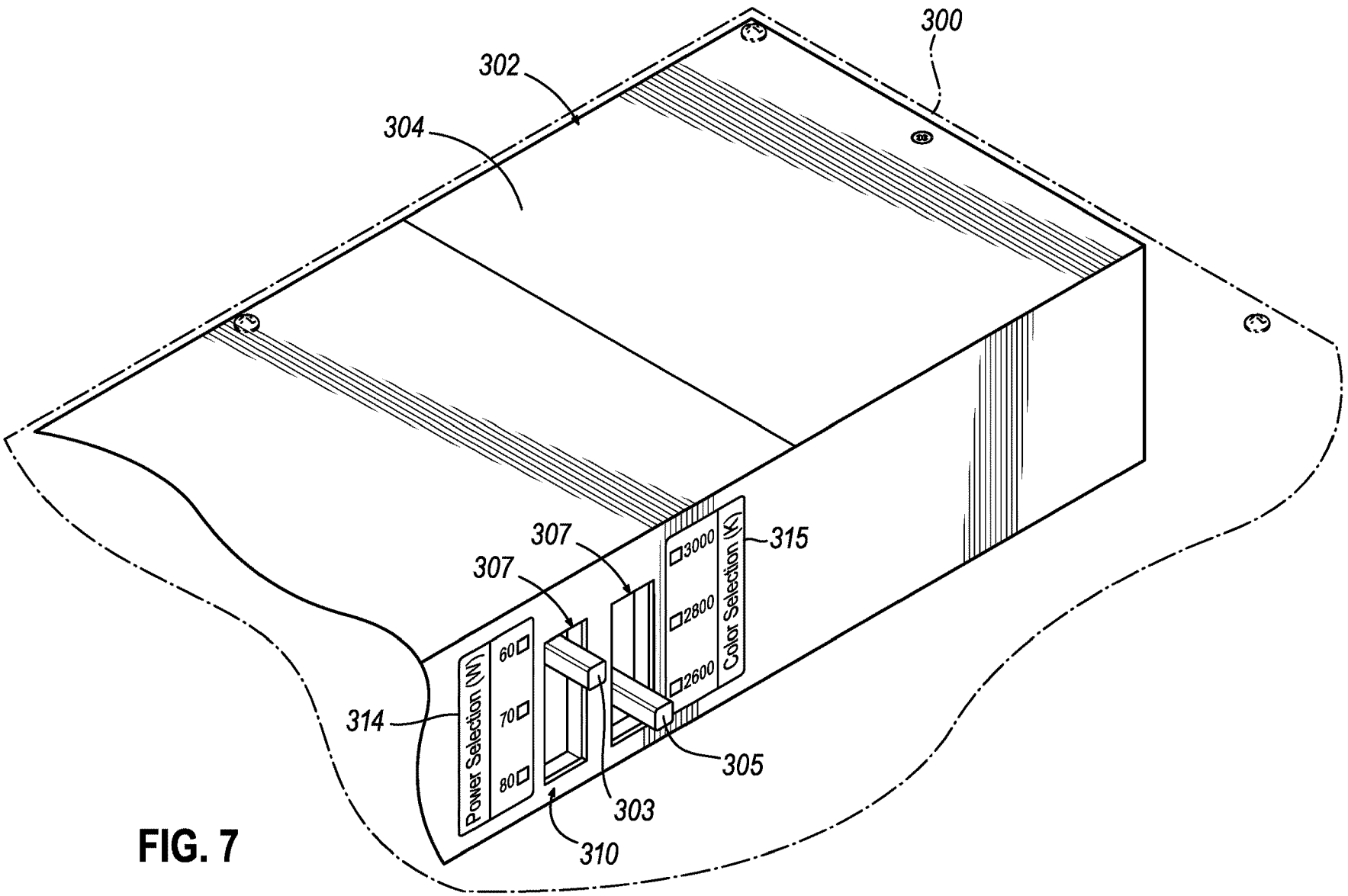
FIG. 7 is a perspective view of a lighting fixture according to yet another embodiment of the present disclosure.

Depicted in FIG. 7 is a luminaire 300 according to a further embodiment of the present disclosure. Luminaire 300 includes one or more light sources (for example, light emitting diodes (LEDs), not depicted), a housing 304 and a controller 302. The one or more light sources in luminaire 300 are functionally controlled, at least in part, by controller 302. Controller 302 includes one or more user selectable illumination control selectors 310 (for example, toggle switches 303 and 305) that control one or more characteristics of the light being illuminated by the light sources. The toggle switches 303 and 305 extend outside the housing 304 of luminaire 300 through one or more illumination selector accesses (for example, apertures 307) allowing access by a user, such as an electrician. Illumination selector legends 314 and 315 may optionally be included to assist a user in placing the toggle switches 303 and 305 in the desired positions.

Figure 8:
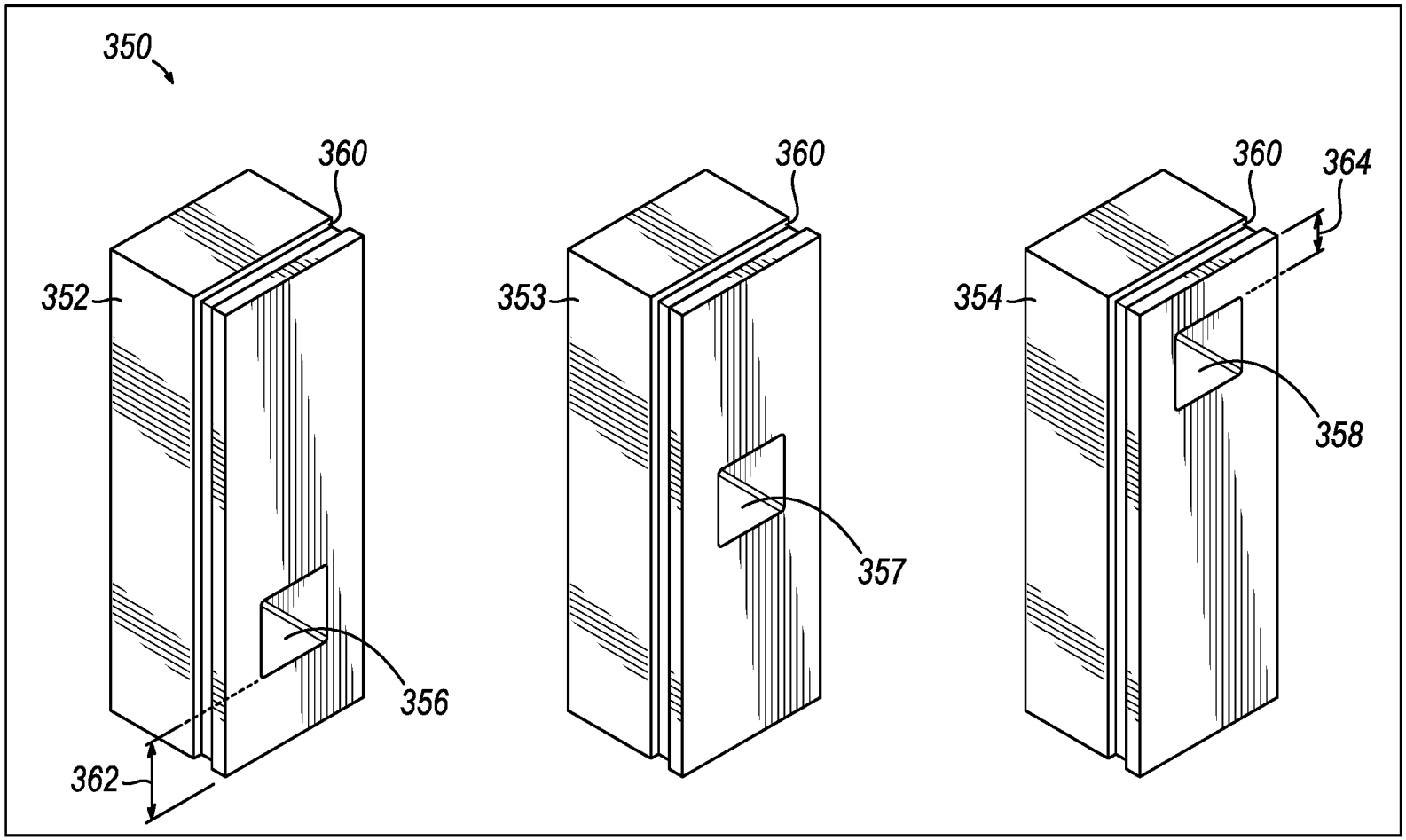
FIG. 8 is a perspective view of switch restraining members according to yet another embodiment of the present disclosure.
Figure 9:
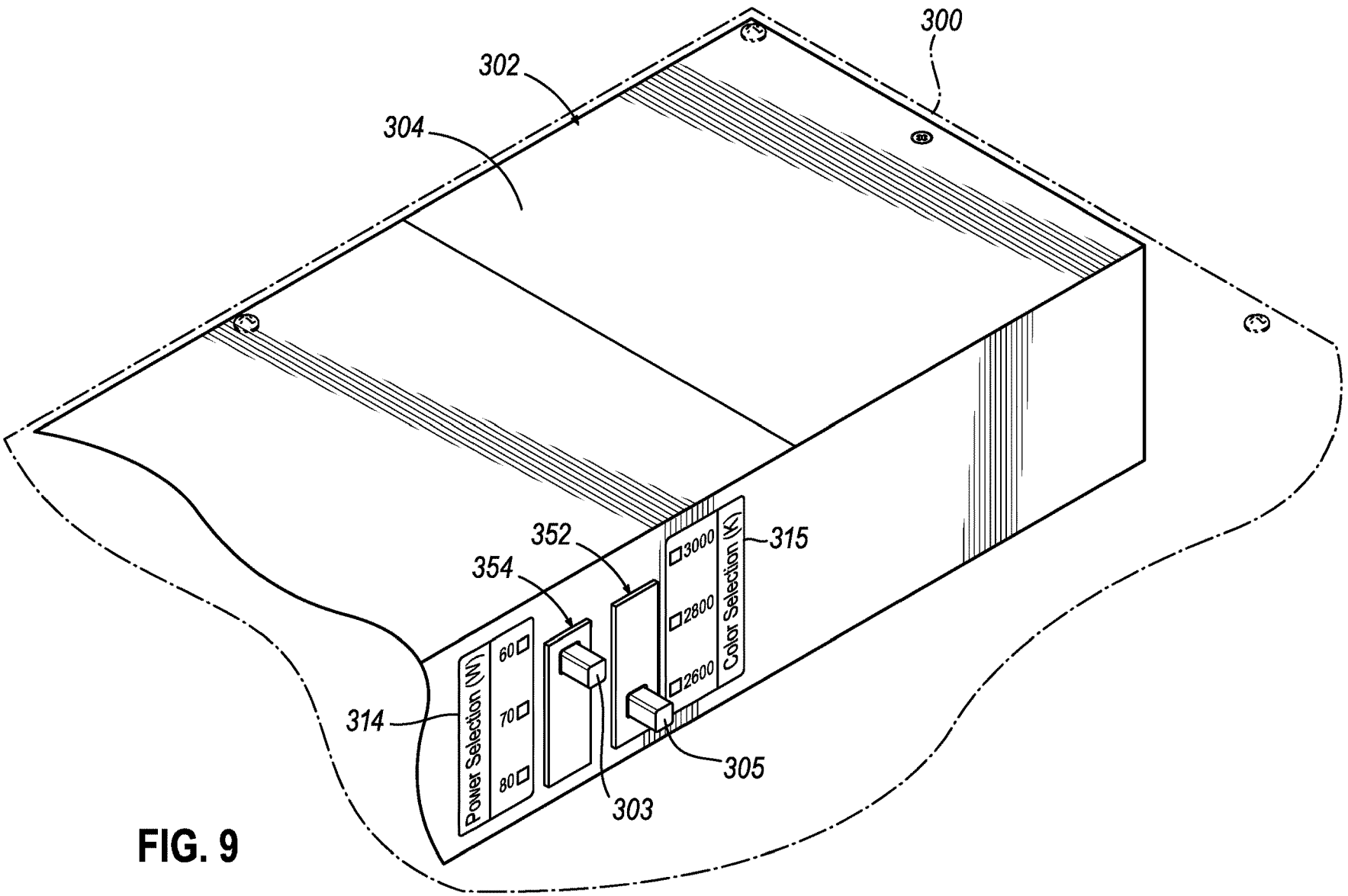
FIG. 9 is a perspective view of two switch restraining members depicted in FIG. 8 inserted into apertures in the lighting fixture depicted in FIG. 7.

Depicted in FIG. 8 are switch restraining members that may be included as at least part of a locking member kit 350 configured and adapted for use with luminaire 300 according to yet another embodiment of the present disclosure. Locking member kit 350 includes one or more switch restraining members, for example locking member 352 and locking member 353. Each of the locking members 352, 353 and 354 includes an illumination selector receiving portion, for example, toggle switch embracing portion 356, toggle switch embracing portion 357 and toggle switch embracing portion 358, respectively, which can embrace the toggle switch (for example, snugly embrace the toggle switch with at least two opposing sides of the outer surface of the toggle switch exert a nonzero contact force (for example, a nonzero pressure) on the inner surface of the aperture 307 into which it is inserted). One or more of the locking members 352, 353 and 354 in the locking member kit 350 optionally include a housing engagement feature, for example, a groove 360, that increases the difficulty in removing the locking member from the housing once the locking member is installed.

Since the external shape of locking members 352, 353 and 354 is rectangular, it is possible to insert each locking members 352, 353 and 354 into apertures 307 in two orientations. For example, each of locking members 352, 353 and 354 can be inserted into apertures 307 (see FIG. 7) in the orientations depicted in FIG. 8 and in orientations in which the locking members 352, 353 and 354 have been rotated 180 degrees from the orientations depicted in FIG. 8. With locking members 352, 353 and 354 rotated 180 degrees from the orientations depicted in FIG. 8, the switch embracing portion 356 of locking member 352 will be oriented toward the upper end of the locking member 352, the switch embracing portion 357 of locking member 353 will be centrally located in locking member 353, and the switch embracing portion 358 of locking member 354 will be oriented toward the lower end of the locking member 354.

However, the locking members in locking member kit 350 include orientation members that will result in the apertures defined by the switch embracing portions 356, 357 and 358 being located in different positions relative to the illumination selection accesses (apertures) 307 if inserted into apertures 307 after being rotated 180 degrees. For example, the switch embracing portion 356 of locking member 352 is located a distance 362 from the edge of locking member 352 that is different from the distance 364 at which the switch embracing portion 358 of locking member 354 is located from the edge of locking member 354. As such, when locking member 352 is rotated 180 degrees from the orientation depicted in FIG. 8 and inserted into an aperture 307, the switch embracing portion 356 will be located a distance 362 from the top edge of aperture 307 ("top" as depicted in FIG. 7), which will be a different distance from the distance 364 that the switch embracing portion 358 of locking member 354 will be located from the top of aperture 307 when locking member 354 is inserted into an aperture 307 while in the orientation depicted in FIG. 8. Similarly, when locking member 353 is rotated 180 degrees from the orientation depicted in FIG. 8 and inserted into an aperture 307, the switch embracing portion 357 will be located a different distance from the top edge of aperture 307 ("top" as depicted in FIG. 7) than the switch embracing portion 357 would be located if the locking member 353 was not rotated from the orientation depicted in FIG. 8 and inserted into aperture 307.

Embodiments where distances 362 and 364 are equal are similar to the locking members in locking member kit 230 depicted in FIG. 5.

In use, a user selects the appropriate positions for toggle switches 303 and 305 to comply with the light output requirements for luminaire 300 and inserts the appropriate one or more locking members (for example, locking member 352, 353 and/or 354) into the one or more housing apertures 206 (which surround toggle switches 203 and 205) and secures one or more toggle switches 203 and 205 in the appropriate positions. When inserted into an aperture 206, the outer surface of the locking member 232 and/or 234 engage the inner surface of the aperture 307 into which the locking member is inserted and the interaction (for example, friction, pressure or other holding force) between the outer surface of the locking member 352, 353 and/or 354 and the inner surface of the aperture 307 into which the locking member is inserted hold the locking member in position within the aperture 307. The embracing portion 356, 357 and/or 358 of the inserted locking member 352, 353 and/or 354 (each embracing portion being at least a portion of an inner surface of an aperture within the respective locking member) receives the toggle switch 303 or 305 (and may embrace the toggle switch 303 or 305 by contacting at least a portion of the toggle switch 303 or 305) and prevents the toggle switch 303 or 305 from moving to a different position. In at least one embodiment, the outer surface of the locking member 352, 353 and/or 354 is larger than the aperture 307 resulting in the locking member 352, 353 and/or 354 being snugly received within the aperture 307. If included with locking members 352, 353 and 354, grooves 360 engage with the border edge of apertures 307 and increase the effort required to remove locking members 352, 353 and 354 from apertures 307.

With the appropriate locking members 352, 353 and 354 positioned within apertures 307 for the desired light output, it is difficult for a user to change the positioning of the toggle switches 303 and 305. For example, a user may need to locate and use a tool and, in some embodiments, a specially designed tool to extract locking members 352, 353 and 354 from apertures 307. In some embodiments extracting locking members 352, 353 and 354 from apertures 307 will physically damage locking members 352, 353 and 354, providing a tamper evident system for assisting possible inspectors in determining whether the positioning of toggle switches 303 and 305 have been changed since installation.

With the appropriate locking members 352, 353 and 354 attached to housing 304, illumination selectors 310 are held in specific positions limiting the output of the light emitters (for example, LED lamps) to particular characteristics (for example, a specific power and/or color), allowing users of luminaire 300 to take advantage of various discounts and/or rebates offered by power companies and/or governmental agencies for using certain types of power or illumination.

While locking member kits 170, 230 and 350 depict two (2) or three (3) locking members, other embodiments include four (4) or more locking members. Similarly, while luminaires 100, 200 and 300 depict two (2) switches for controlling an illumination characteristic of the light emitter (s), other embodiments include luminaires with one (1) switch, and still other embodiments include luminaires with three (3) or more switches.

The locking members in one or more of the embodiments may comprise, or be solely constructed of, silicone or some other type of material that allows insertion of the locking member into an aperture in a lighting fixture and difficulty removing the locking member from the aperture. In some embodiments the locking members comprise, or are solely constructed of, materials that are commonly referred to as plastics, and may be elastomeric in nature.

Reference systems that may be used herein can refer generally to various directions (e.g., upper, lower, forward and rearward), which are merely offered to assist the reader in understanding the various embodiments of the disclosure and are not to be interpreted as limiting. Other reference systems may be used to describe various embodiments, such as referring to the direction of projectile movement as it exits the firearm as being up, down, rearward or any other direction.

While examples, one or more representative embodiments and specific forms of the disclosure have been illustrated and described in detail in the drawings and foregoing description, the same is to be considered as illustrative and not restrictive or limiting. The description of particular features in one embodiment does not imply that those particular features are necessarily limited to that one embodiment. Some or all of the features of one embodiment can be used or applied in combination with some or all of the features of other embodiments unless otherwise indicated. One or more exemplary embodiments have been shown and described, and all changes and modifications that come within the spirit of the disclosure are desired to be protected.

Element Numbering

Table 1 includes element numbers and at least one word used to describe the member and/or feature represented by the element number. It is understood that none of the embodiments disclosed herein are limited to these descriptions, other words may be used in the description or claims to describe a similar member and/or feature, and these element numbers can be described by other words that would be understood by a person of ordinary skill reading and reviewing this disclosure in its entirety.

TABLE 1

| | |
|---|---|
| 100 | luminaire |
| 102 | controller |
| 103 | illumination selector |
| 104 | housing |
| 105 | illumination selector |
| 108 | aperture |
| 110 | illumination selector |
| 116 | legend |
| 170 | locking member kit |
| 172 | locking member |
| 173 | locking member |
| 174 | locking member |
| 176 | switch embracing portion |
| 177 | switch embracing portion |
| 178 | switch embracing portion |
| 180 | groove |
| 181 | orientation feature |
| 182 | orientation feature |
| 184 | identification feature |
| 185 | identification feature |
| 186 | identification feature |
| 200 | luminaire |
| 202 | controller |
| 203 | illumination selector |
| 204 | housing |
| 206 | aperture |
| 210 | illumination selector |
| 212 | legend |
| 230 | locking member kit |
| 232 | locking member |

TABLE 1-continued

| | |
|---|---|
| 234 | locking member |
| 236 | embracing portion |
| 238 | embracing portion |
| 240 | groove |
| 300 | luminaire |
| 302 | controller |
| 303 | illumination selector |
| 304 | housing |
| 307 | aperture |
| 310 | illumination selector |
| 314 | legend |
| 350 | locking member kit |
| 352 | locking member |
| 353 | locking member |
| 354 | locking member |
| 356 | embracing portion |
| 357 | embracing portions |
| 358 | embracing portion |
| 360 | groove |
| 362 | distance |
| 364 | distance |

What is claimed is:

1. An apparatus limiting an ability of a user to change a position of a multi-position switch that affects at least one characteristic of a light emitting member, the apparatus comprising:

a body defining an outer surface and a switch receiving portion, the outer surface configured to be held in position by interaction with an aperture surrounding the multi-position electrical switch of a lighting fixture, the switch affecting at least one characteristic of the light emitting member when moved from a first position to a second position, and the switch receiving portion configured to receive the multi-position switch when the multi-position switch is in the first position and inhibit the multi-position switch from moving to the second position.

2. The apparatus of claim 1, wherein the outer surface defines the switch receiving portion.

3. The apparatus of claim 1, wherein the outer surface of the body is configured to be received within the aperture without damage in a single rotational orientation with respect to the aperture.

4. The apparatus of claim 1, wherein the body is a first body, the apparatus comprising:

a second body defining a second outer surface and a second light switch receiving portion, the second outer surface configured to be snugly received within the aperture surrounding the multi-position switch, and the second switch receiving portion configured to receive the multi-position switch when the multi-position switch is in the second position and inhibit the multi-position switch from moving to the first position.

5. The apparatus of claim 1, wherein removing the body from the aperture results in damage to the body that is apparent to the user.

6. The apparatus of claim 1, wherein removing the body from the aperture results in damage to the body that is apparent to the user when the body is reinserted into the aperture.

7. The apparatus of claim 1, wherein the body is a body of unitary construction.

8. The apparatus of claim 7, wherein the body is constructed of an elastomeric material.

9. The apparatus of claim 1, wherein the switch receiving portion is configured to receive a toggle switch.

10. The apparatus of claim 1, wherein the user is unable to remove the body from the aperture without use of a tool.

11. The apparatus of claim 1, wherein the outer surface of the body is larger than the aperture resulting in the body being snugly received within the aperture.

12. A kit for a light fixture, comprising:

a light fixture housing defining an aperture;

a light emitting member mounted to the light fixture housing;

a switch connected to the light emitting member and configured to extend through the aperture, the switch affecting at least one aspect of the light being emitted from the light emitting member when moved between a first position and a second position;

a first body defining a first outer surface and a first body switch receiving portion, the first outer surface configured to be received by the aperture, and the first body switch receiving portion being configured to receive the switch when the switch is in a first position and inhibit the switch from moving to a second position; and a second body defining a second outer surface and a second switch receiving portion, the second outer surface configured to be received by the aperture, and the second body switch receiving portion being configured to receive the switch when the switch is in the second position and inhibit the switch from moving to the first position.

13. The kit of claim 12, wherein the first outer surface and the second outer surface are configured to be received within the aperture without damage, each being received in a single rotational orientation with respect to the aperture.

14. The kit of claim 12, wherein removing the first body from the aperture results in damage to the first body that is apparent to a user when the first body is reinserted into the aperture, and wherein removing the second body from the aperture results in damage to the second body that is apparent to a user when the second body is reinserted into the aperture.

15. The kit of claim 12, wherein the first body is an elastomeric body of unitary construction and the second body is an elastomeric body of unitary construction.

16. The kit of claim 12, wherein the first outer surface defines the first body switch receiving portion and the second outer surface defines the second body switch receiving portion.

17. The kit of claim 12, wherein the switch receiving portion is configured to receive a toggle switch.

18. The kit of claim 12, wherein the first body is held in position within the aperture by the contact force between the outer surface of the first body and the aperture, and wherein the second body is held in position within the aperture by the contact force between the outer surface of the second body and the aperture.

19. A kit that limits movement of a light switch that controls at least one aspect of a light emitting from a light fixture, the light switch extending through an aperture in a housing of the light fixture, the kit comprising:

a first light switch movement inhibiting member including means for orienting the first light switch movement inhibiting member in a single orientation within a light housing aperture and inhibiting the light switch from moving from a first light switch position to a second light switch position when the first light switch movement inhibiting member is received within the aperture in the light housing; and a second light switch movement inhibiting member including means for orienting the second light switch movement inhibiting member in a single orientation within the light housing aperture and inhibiting the light switch from moving from the second light switch position to the first light switch position when the second light switch movement inhibiting member is received within the light housing aperture.

20. The kit of claim 19, wherein the means for orienting the first light switch movement inhibiting member includes a light switch embracing portion that embraces the light switch in the first light switch position and a key that orients the first light switch movement inhibiting member in a single orientation within the housing of the light fixture, and wherein the means for orienting the second light switch movement inhibiting member includes a light switch embracing portion that embraces the light switch in the second light switch position and a key that orients the second light switch movement inhibiting member in a single orientation within the housing of the light fixture.

* * * * *